US005756253A

United States Patent [19]

Eckert et al.

[11] Patent Number: 5,756,253

[45] Date of Patent: May 26, 1998

[54] PHOTOGRAPHIC ELEMENT AND METHOD

[75] Inventors: Robert D. Eckert, Lexington; Michael P. Filosa, Medfield; Gerard Gomes, West Boylston, all of Mass.; Anthony R. Layne, Hudson, N.H.; Marlene C. Schwarz, Newton; Lloyd D. Taylor, Lexington, both of Mass.

[73] Assignee: Polaroid Corporation, Cambridge, Mass.

[21] Appl. No.: 890,463

[22] Filed: Jul. 9, 1997

[51] Int. Cl.[6] ..... G03C 8/32; G03C 8/36; G03C 5/305; G03C 5/38

[52] U.S. Cl. ..... 430/219; 430/216; 430/227; 430/233; 430/240; 430/244; 430/248; 430/249; 430/456; 430/488; 430/489; 430/490; 430/491

[58] Field of Search ..... 430/218, 219, 430/216, 227, 244, 249, 248, 488, 489, 490, 491, 233, 240, 239, 456

[56] References Cited

U.S. PATENT DOCUMENTS

| | | | |
|---|---|---|---|
| 4,168,166 | 9/1979 | Land | 96/3 |
| 4,324,853 | 4/1982 | Berger | 430/245 |
| 4,503,139 | 3/1985 | Bartels-Keith et al. | 430/219 |
| 4,565,774 | 1/1986 | Kajiwata et al. | 430/489 |

*Primary Examiner*—Richard L. Schilling
*Attorney, Agent, or Firm*—Jennifer A. Kispert

[57] ABSTRACT

There are described novel photographic processing compositions, film units and processes for use in diffusion transfer photographic systems. More particularly, there is described a method for forming a diffusion transfer image photographic processing of diffusion transfer photographic film units in the presence of hypoxanthine and inosine. Diffusion transfer photographic systems utilizing the novel photographic element or method of the present invention exhibit substantially fewer, if any, crystals on the final image of the finished photograph post-processing.

20 Claims, No Drawings

PHOTOGRAPHIC ELEMENT AND METHOD

This invention relates to novel photographic processing compositions, film units and processes for use in diffusion transfer photographic systems. More particularly, the invention relates to a method for photographic processing of diffusion transfer photographic film units in the presence of hypoxanthine and inosine.

BACKGROUND OF THE INVENTION

Diffusion transfer photographic processes are well known in the art. Such processes have in common the feature that the final image is a function of the formation of an imagewise distribution of an image-providing material and the diffusion transfer of the imagewise distribution to an image-receiving layer. In general, a diffusion transfer image is obtained first by exposing to actinic radiation a photosensitive element, or negative film component, which comprises at least one light-sensitive silver halide layer, to form a developable image. Thereafter, this image is developed by applying an aqueous alkaline processing fluid to form an imagewise distribution of soluble and diffusible image dye-providing material, and transferring this imagewise distribution by diffusion to a superposed image-receiving layer of an image-receiving element, or positive film component, to impart a transfer image thereto.

The aqueous processing compositions employed in diffusion transfer processes are usually highly alkaline (e.g., above about pH 12). After processing has been allowed to proceed for a predetermined period of time, it is desirable to neutralize the alkali of the processing composition to prevent further development and image dye transfer, and, in some instances, subsequent oxidation which may have a material and substantial effect upon the stability to light of the resulting image in the image-receiving layer. Accordingly, a neutralizing layer, typically a nondiffusible acid-reacting reagent, is employed in the film unit to lower the pH from a first (high) pH of the processing composition to a predetermined second (lower) pH.

To ensure that the pH reduction occurs after a sufficient, predetermined period and not prematurely so as to interfere with the development process, e.g., stop the transfer of image dyes which may result in, for example, a pale, i.e., low density, image of undesirable color balance, a timing layer is typically positioned before the neutralization layer.

Diffusion transfer photographic materials known in the art include those wherein the photosensitive silver halide emulsion layer(s) and the image-receiving layer are initially contained in separate elements which are brought into superposition subsequent or prior to exposure. Alternatively, the photosensitive layer(s) and the image-receiving layer may initially be in a single element wherein the photosensitive and image-receiving components are retained together in an integral negative-positive structure. In either case, after development the two elements may be retained together in a single film unit, i.e., often referred to an integral film unit, or separated, i.e., often referred to as a peel-apart film unit.

As is understood by those of skill in the art, in some instances, with time, generally, about one month after photographic processing, the final image exhibits raised areas of various shapes and disposition which have been attributed, for example, to crystal formation or a "salting out" of one or more of the components of the aqueous alkaline processing composition, or, to the processing of the photographic film unit. It would also be appreciated by one of skill in the art that, in some instances, interior crystal formation, i.e., the crystals are located within the film unit structure, may also contribute to the above-described defects in the final image of the finished photograph, i.e., the crystals are large enough to protrude into the image- receiving layer and, thus, render the final image visually objectionable.

Efforts have been made to eliminate such crystal formation by including materials in the aqueous alkaline processing compositions, such as, for example, an alkali-soluble borate compound as disclosed and claimed in U.S. Pat. No. 4,168,166 or, a saturated polyol as disclosed and claimed in U.S. Pat. No. 4,324,853.

While such materials have been found to provide advantageous results as are described in the above-mentioned patents; nevertheless, their performance in some photographic systems is not completely satisfactory, such as, for example, where an aqueous alkaline processing composition include materials, such as, for example, heterocyclic purines. Heterocyclic purines, e.g., 6-hydroxypurine or hypoxanthine, tend to form self-associations by, for example, hydrogen bonding, which, in some instances, results in visible crystal formation in the final image of a finished photograph over time, e.g., about one month after photographic processing.

As the state of the art for photographic systems advances, novel techniques and materials continue to be developed by those skilled in the art in order to attain the performance criteria required of such materials. There is a need for novel photographic processing compositions, film units and methods for use in diffusion transfer photographic systems that have advantages over those already known to the art; hence, investigations continue to be pursued to provide such advantages.

Accordingly, the present invention relates to a novel method for photographic processing of diffusion transfer photographic film units in the presence of hypoxanthine and inosine which results in an image of desirable sensitometry, and substantially fewer, if any, hypoxanthine crystals on the final image of the finished photograph with time after photographic processing.

SUMMARY OF THE INVENTION

These and other objects and advantages are accomplished in accordance with the invention by providing a process for use in diffusion transfer photographic systems, and particularly, an aqueous alkaline processing composition and a diffusion transfer photographic film unit used therewith.

The present invention is directed to a method for photographic processing of a diffusion transfer photographic film unit in the presence of hypoxanthine and inosine. As is well known in the art, hypoxanthine is typically incorporated in the diffusion transfer photographic film unit as a component of the aqueous alkaline processing composition. Inosine may be incorporated in the diffusion transfer photographic film unit of the present invention either as a component of the aqueous alkaline processing composition, or, as a layer of the diffusion transfer photographic film unit.

The method of the present invention for forming a diffusion transfer image includes the steps of: exposing a photosensitive element comprising a support carrying at least one silver halide emulsion layer to an imagewise pattern of radiation; developing the exposed photosensitive element with an aqueous alkaline processing composition in the presence of inosine, wherein the processing composition includes hypoxanthine; and forming an image on an image-receiving layer.

The method of the present invention may employ any suitable diffusion transfer photographic film unit, such as, for example, a film unit which includes a support; at least one silver halide emulsion layer; an image-receiving layer; an aqueous alkaline processing composition which contains hypoxanthine; and inosine.

In a preferred embodiment inosine is incorporated in the diffusion transfer photographic film unit as a component of the aqueous alkaline processing composition. In another preferred embodiment inosine is incorporated in the diffusion transfer photographic film unit as a component of a layer of the film unit, such as, for example, in a polymeric acid reacting layer of the photosensitive element of the film unit. Any suitable amount of inosine may be incorporated in the diffusion transfer film units of the present invention, and routine scoping tests based on the information provided herein may be conducted to ascertain the appropriate amount of inosine for any given film unit.

The novel method of the present invention for processing a diffusion transfer photographic film unit may be used in conjunction with any photographic emulsion, and may be used to process any exposed photosensitive element, e.g., integral or peel-apart, including photographic systems for forming images in black and white or in color and those wherein the final image is a metallic silver image or one formed by other image-forming materials, such as, for example, image dye-providing materials.

The method of the present invention may employ any suitable processing composition comprising hypoxanthine, such as, for example, a processing composition which includes a silver halide developing agent, a silver halide solvent, hypoxanthine and inosine.

It has now been unexpectedly discovered that, by including inosine in the photographic processing of diffusion transfer photographic film units, the crystals which may develop on the final image of a finished photograph with time after photographic processing can be substantially eliminated.

While not intending to be bound by theory, it is believed that the crystals are the result of the self-association of the hypoxanthine molecules comprising the aqueous alkaline processing composition incorporated in the diffusion transfer film unit of the present invention. The self-association may occur through inter-molecular hydrogen bonding of the hypoxanthine molecules causing the hypoxanthine molecules to, in effect, "stack" and grow large crystals.

Inosine is very similar in chemical structure to hypoxanthine, more particularly, a hydrogen atom of hypoxanthine is replaced by a ribose moiety:

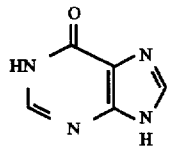

Hypoxanthine

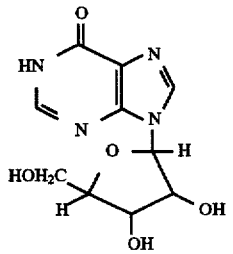

Inosine

Although it is not fully understood, it is possible that the inosine substantially prevents the above-mentioned self-association of hypoxanthine molecules, by, for example, sterically blocking the self-association sites and/or by inserting itself into the crystal lattices of the associated hypoxanthine molecules to, in effect, form smaller "mixed" crystals as opposed to larger homogeneous hypoxanthine crystals.

In addition, the sugar functionality, i.e., ribose moiety, of the inosine molecule may also assist in preventing the crystal formation due to its rendering the inosine molecule appreciably soluble in aqueous solutions, e.g., aqueous alkaline processing compositions, and aqueous coatings of neutral or less alkaline pH, e.g., a polymeric acid reacting layer coated on a photosensitive element of a film unit, in contrast to hypoxanthine, which is appreciably insoluble in aqueous solutions at neutral or less alkaline pH.

These and other objects and advantages which are provided in accordance with the invention will in part be obvious and in part be described hereinafter in conjunction with the detailed description of various preferred embodiments of the invention. The invention accordingly comprises the processes involving the several steps and relation and order of one or more of such steps with respect to each of the others, and the product and compositions possessing the features, properties and relation of elements which are exemplified in the following detailed disclosure, and the scope of the application of which will be indicated in the claims.

For a fuller understanding of the nature and objects of the invention, reference should be had to the following detailed description of the preferred embodiments.

DESCRIPTION OF THE PREFERRED EMBODIMENTS

The hypoxanthine and inosine compounds which are suitable for use in the present invention are well known compounds, and, as such, may be prepared using techniques which are well known to those of skill in organic chemistry, and techniques such as described in, for example, U.S. Pat. Nos. 5,108,893; 4,931,431; 4,845,215; and 4,602,089, and U.S. Pat. Nos. 5,614,504; 4,958,017; 4,701,413; 4,452,889; 3,960,661; 3,111,459 and 3,049,536, respectively. Furthermore, hypoxanthine may be prepared from inosine by, e.g., boiling inosine with 0. 1N $H_2SO_4$ (see, *The Merck Index*, 11 Ed., Merck & Co., Inc., page 788 (1989)). See also, Harper's Biochemistry, 24 Ed., Chapter 36, page 380 (Lange, 1996). It will be appreciated by those of ordinary skill in the art, however, that any suitable method for preparing hypoxanthine and inosine may be employed in the present invention.

For example, as described in *The Merck Index* at page 774, hypoxanthine may be prepared using numerous known syntheses, including, for example, from 2,6,8-trichloropurine (citing: Fischer, *Ber.* 30, 2226 (1897)); by the oxidation of adenine (citing: Krüger, *Z. Physiol. Chem.* 18, 445 (1894)); by the 5 reduction of uric acid (citing: Sundwik, ibid. 76, 486 (1912)); by condensing ethyl cyanoacetate and thiourea in the presence of Na-ethoxide (citing: Traube, *Ann.* 331, 64 (1904)); and, from mercapto-4-hydroxy-6-aminopyrimidine (citing: Taylor, Cheng. *J. Org. Chem.* 25, 148 (1960)). Those of skill in organic chemistry would understand how to perform such syntheses.

In addition, as described in *The Merck Index* at page 788, inosine may be prepared using numerous known syntheses, including, for example, from adenosine by incubation with purified adenosine deaminase from intestine (citing: Kalckar, *J.*

Biol. Chem. 167, 445 (1947)); by the action of sodium nitrite and acetic acid on adenosine (citing: Levene, Jacobs,

*Ber.* 43, 3161 (1910)); by the use of barium nitrite 15 and $H_2SO_4$ (citing: Reiff et al., U.S. Pat. No. 3,049,536)); and, by fermentation (citing: U.S. Pat. No. 3,111,459). Those of skill in organic chemistry would understand how to perform such syntheses.

It will be appreciated by those of ordinary skill in the art that the amount of inosine necessary in any specific instance is dependent upon a number of factors such as, for example, the type of diffusion transfer film unit, where the inosine is incorporated within the film unit, e.g., as a component of the processing composition or as a component of a layer of the film unit, and the result desired, e.g., a final image, which after processing, remains substantially free of crystals.

In embodiments of the present invention wherein the inosine is incorporated into a layer of the diffusion transfer photographic film unit, the layer may include any other suitable material necessary to realize the function of that particular layer, provided that, the other materials comprising such a layer do not adversely affect or negate the ability of inosine to substantially eliminate hypoxanthine crystal formation which may appear on the final image of a finished photograph with time after photographic processing.

In a preferred embodiment of the present invention inosine is incorporated in the diffusion transfer photographic film unit as a component of the aqueous alkaline processing composition, and preferred weight ratios of hypoxanthine to inosine are from about 0.50:0.05 to about 1.0:0.5, particularly preferred weight ratios of hypoxanthine to inosine are from about 0.75:0.1 to about 0.75:0.3, and an specially preferred weight ratio of hypoxanthine to inosine is about 0.75:0.2.

In a preferred embodiment where inosine is included in the processing composition, the processing composition comprises from about 0.05% by weight to about 0.5% by weight of inosine.

In another preferred embodiment where inosine is included in the processing composition, the processing composition comprises from about 0.10% by weight to about 0.30% by weight of inosine.

In another preferred embodiment where inosine is included in the processing composition, the processing composition comprises from about 0.10% by weight to about 0.30% by weight of inosine and from about 0.5% by weight to about 1.0% by weight of hypoxanthine.

In another preferred embodiment where the inosine is incorporated in a layer of the film unit, preferred weight ratios of hypoxanthine in the processing composition to inosine in the layer are from about 0.75:0.0136 to about 0.75:0.0909, particularly preferred weight ratios of hypoxanthine to inosine are from about 0.75:0.0272 to about 0.75:0.0818, and especially preferred weight ratios of hypoxanthine to inosine are about 0.75:0.0136 to about 0.75:0.0272.

As previously stated, there are provided according to the present invention diffusion transfer photographic film units which include hypoxanthine in the processing composition incorporated therein, and inosine. In one embodiment, the inosine is a component of the processing composition. In another embodiment inosine is incorporated in a layer of the diffusion transfer photographic film unit. In a preferred embodiment of the present invention wherein a diffusion transfer photographic film unit includes a photosensitive element, inosine is incorporated in a layer of the photosensitive element. In a particularly preferred embodiment of the present invention wherein a diffusion transfer photographic film unit includes a photosensitive element comprising a polymeric acid-reacting layer, the polymeric acid-reacting layer comprises inosine.

The novel method of the present invention for processing a diffusion transfer photographic film unit, including the integral and peel-apart types, may be used in conjunction with any photographic emulsion, and may be used to process any exposed photosensitive element including photographic systems for forming images in black and white or in color and those wherein the final image is a metallic silver image or one formed by other image-forming materials, such as, for example, image dye-providing materials.

Image-recording elements useful in both black and white and color photographic imaging systems, e.g., integral and peel-apart, are well known in the art and, therefore, extensive discussion of such materials is not necessary. It should be noted, however, that although the diffusion transfer film unit of the present invention is preferably used in photographic systems which include a rupturable container or "pod," as is known in the art, which releasably contains an aqueous alkaline processing composition; nonetheless, the diffusion transfer film unit of the present invention may also be used in photographic systems which do not utilize a pod.

In addition, the novel method of the present invention may be used in conjunction with any photographic emulsion. In the preferred diffusion transfer film units of the invention, it is preferred to include a negative working silver halide emulsion, i.e., one which develops in the areas of exposure. Further, the novel method of the present invention may be used in association with any image dye-providing materials, for example, complete dyes or dye intermediates, e.g., color couplers, or dye-developers. The dye developers contain, in the same molecule, both the chromophoric system of a dye and a silver halide developing function as is described in U.S. Pat. No. 2,983,606.

In a particularly preferred embodiment the diffusion transfer photographic film elements of the invention include one or more image dye-providing materials which may be initially diffusible or nondiffusible. In diffusion transfer photographic systems the image dye-providing materials which can be utilized generally may be characterized as either (1) initially soluble or diffusible in the processing composition but which are selectively rendered nondiffusible imagewise as a function of development or (2) initially insoluble or nondiffusible in the processing composition but which selectively provide a diffusible product imagewise as a function of development. The requisite differential in mobility or solubility may be obtained, for example, by a chemical reaction such as a redox reaction as is the case with dye developers, a coupling reaction or by a silver-assisted cleavage reaction as is the case with thiazolidines. As noted previously, more than one image-forming mechanism may be utilized in the multicolor diffusion transfer film units of the present invention.

Other image dye-providing materials which may be used include, for example, initially diffusible coupling dyes such as are useful in the diffusion transfer process described in U.S. Pat. No. 2,087,817 which are rendered nondiffusible by coupling with the oxidation product of a color developer; initially nondiffusible dyes which release a diffusible dye following oxidation, sometimes referred to as "redox dye releaser" dyes, described in U.S. Pat. Nos. 3,725,062 and 4,076,529; initially nondiffusible image dye-providing materials which release a diffusible dye following oxidation and intramolecular ring closure as are described in U.S. Pat. No. 15 3,433,939 or those which undergo silver assisted cleavage to release a diffusible dye in accordance with the disclosure of U.S. Pat. Nos. 3,719,489 and 5,569,574; and initially nondiffusible image dye-providing materials which release a diffusible dye following coupling with an oxidized color developer as described in U.S. Pat. No. 3,227,550. In a particularly preferred embodiment of the invention the image dye-providing materials are dye-developers which are initially diffusible materials.

U.S. Pat. Nos. 3,719,489 and 4,098,783 disclose diffusion transfer processes wherein a diffusible image dye is released from an immobile precursor by silver-initiated cleavage of certain sulfur-nitrogen containing compounds, preferably a cyclic 1,3-sulfur nitrogen ring system, and most preferably a thiazolidine compound.

For convenience, these compounds may be referred to as "image dye-releasing thiazolidines". The same release mechanism is used for all three image dyes, and, as will be readily apparent, the image dye-forming system is not redox controlled.

U.S. Pat. No. 5,569,574 discloses diffusion transfer processes wherein a diffusible image dye is released from an immobile precursor by silver-initiated cleavage of certain sulfur-oxygen containing compounds, preferably, a 1,3-sulfur-oxygen ring system.

A technique which utilizes two different imaging mechanisms, namely dye developers and image dye-releasing thiazolidines, is described U.S. Pat. Nos. 4,777,112; 4,794,067 and 5,422,233, and is described and claimed in U.S. Pat. No. 4,740,448. According to this process the image dye positioned the greatest distance from the image-receiving layer is a dye developer and the image dye positioned closest to the image-receiving layer is provided by an image dye-releasing thiazolidine. The other image dye-providing material may be either a dye developer or an image dye-releasing thiazolidine. Particularly preferred diffusion transfer film units according to the present invention include, as image dye-providing materials, both dye developers and dye-providing thiazolidine compounds as described in U.S. Pat. No. 4,740,448.

The diffusion transfer photographic systems utilizing the diffusion transfer film units of the present invention may include any of the known diffusion transfer multicolor films. Particularly preferred diffusion transfer photographic film units according to the invention are those intended to provide multicolor dye images. The most commonly employed photosensitive elements for forming multicolor images are of the "tripack" structure and contain blue-, green- and red-sensitive silver halide emulsion layers each having associated therewith in the same or a contiguous layer a yellow, a magenta and a cyan image dye-providing material, respectively.

Suitable photosensitive elements and their use in the processing of diffusion transfer photographic images are well known and are disclosed, for example, in U.S. Pat. No. 2,983,606; and in U.S. Pat. Nos. 3,345,163 and 4,322,489.

U.S. Pat. No. 2,983,606 discloses a subtractive color film which employs red-sensitive, green-sensitive and blue-sensitive silver halide layers having associated therewith, respectively, cyan, magenta and yellow dye developers. In such films, oxidation of the dye developers in exposed areas and consequent immobilization thereof has provided the mechanism for obtaining imagewise distribution of unoxidized, diffusible cyan, magenta and yellow dye developers which are transferred by diffusion to an image-receiving layer. While a dye developer itself may develop exposed silver halide, in practice the dye developer process has utilized a colorless developing agent, sometimes referred to as an "auxiliary" developer, a "messenger" developer or an "electron transfer agent", which developing agent develops the exposed silver halide. The oxidized developing agent then participates in a redox reaction with the dye developer thereby oxidizing and immobilizing the dye developer in imagewise fashion. A well known messenger developer has been 4'-methylphenylhydroquinone. Commercial diffusion transfer photographic films of Polaroid Corporation including Polacolor® SX-70, Time Zero® and 600 have used cyan, magenta, and yellow dye developers.

The diffusion transfer photographic materials of the present invention include those wherein the photosensitive silver halide emulsion layer(s) and the image-receiving layer are initially contained in separate elements which are brought into superposition subsequent or prior to exposure. Alternatively, the photosensitive layer(s) and the image-receiving layer may initially be in a single element wherein the negative and positive components are retained together in an integral structure. In either case, after development the two elements may be retained together in a single film unit, i.e., an integral negative-positive film unit, or separated from each other, i.e., a peel-apart film unit.

As stated above, the multicolor diffusion transfer photographic film units of the invention include those where the photosensitive element and the image-receiving element are maintained in superposed relationship before, during and after exposure as described in U.S. Pat. No. 3,415,644. In commercial embodiments of this type of film (e.g., SX-70 film) the support for the photosensitive element is opaque, the support for the image-receiving element is transparent and a light-reflecting layer against which the image formed in the image-receiving layer may be viewed is formed by distributing a layer of processing composition containing a light-reflecting pigment (titanium dioxide) between the superposed elements. By also incorporating suitable pH-sensitive optical filter agents, preferably pH-sensitive phthalein dyes, in the processing composition, as described in U.S. Pat. No. 3,647,347, the film unit may be ejected from the camera immediately after the processing composition has been applied with the process being completed in ambient light while the photographer watches the transfer image emerge. As is known in the art, the concentrations of the light-reflecting pigment and the optical filter agent are chosen such that the layer of photographic processing composition comprising these components is sufficiently opaque to light actinic to the, e.g., silver halide emulsion, derived from, for example, ambient light incident to and transmitted through the transparent support of the image-receiving element of the integral film unit.

As is also well understood by those of skill in the art, the light-absorbing capacity of the optical filter agent is "cleared" or substantially reduced after this capacity is no longer needed, as described in, for example, U.S. Pat. No. 4,298,674, so that the optical filter agent need not be removed from the film unit, i.e., the optical filter agent will not exhibit any visible absorption which could degrade the transfer image or the white background provided by the reflecting layer. In embodiments of the present invention wherein the diffusion transfer photographic film unit includes a light-reflecting pigment and an optical filter agent, any suitable method of clearing the light-absorbing capacity of the optical filter agent may be employed, including, for example, and preferably, the use of a layer as disclosed and claimed in copending, commonly-assigned U.S. patent application, Ser. No. 08/890,500 filed on even date herewith.

As noted above, subtractive multicolor diffusion transfer films comprise a blue-sensitive silver halide emulsion in association with a yellow image dye, a green-sensitive silver halide emulsion in association with a magenta image dye, and a red-sensitive silver halide emulsion in association with a cyan image dye. Each silver halide emulsion and its associated image dye-providing material may be considered to be a "sandwich", i.e., the red sandwich, the green sandwich and the blue sandwich. Similarly, the associated layers which cooperate (e.g., the red-sensitive silver halide emulsion and its associated cyan dye developer) to create each imagewise distribution of diffusible image dye may be referred to collectively as, e.g., the red image component of the photosensitive element. It should be noted that the particular image component may contain other layers such as interlayers and timing layers.

As stated earlier, the present invention may be practiced with any multicolor diffusion transfer photographic film units and these film units may include any image dye-providing materials. In the particularly preferred embodiments of the invention the cyan and magenta image dyes are dye developers and the yellow image dye is a thiazolidine. In a particularly preferred embodiment the red sandwich, or image component, is positioned closest to the support for the photosensitive element and the blue image component is positioned farthest from the support of the photosensitive element and closest to the image-receiving layer.

Briefly, for example, a preferred embodiment of a diffusion transfer photographic film unit generally includes: a support; at least one silver halide emulsion layer; an image-receiving layer; an aqueous alkaline processing composition which includes hypoxanthine; and inosine.

A preferred embodiment of a diffusion transfer photographic film unit of the present invention includes: (1) a photosensitive element comprising a support carrying at least one silver halide emulsion layer; (2) an image-receiving element comprising a support carrying an image-receiving layer; (3) a rupturable container releasably holding a photographic processing composition comprising hypoxanthine, and so positioned as to be adapted to distribute the photographic processing composition between predetermined layers of the elements; and (4) inosine in either the photographic processing composition or in a layer of either of the elements.

In addition, a preferred embodiment of a diffusion transfer photographic film unit wherein the photosensitive and the image-receiving elements are of the peel-apart type generally includes: (a) a photosensitive element comprising a support carrying at least one silver halide emulsion layer; (2) an image-receiving element comprising a support carrying an image-receiving layer, a polymeric acid reacting layer, a timing layer, an overcoat layer and a stripcoat layer; (3) a rupturable container releasably holding a photographic processing composition comprising hypoxanthine, and so positioned as to be adapted to distribute the photographic processing composition between predetermined layers of the elements; and (4) inosine in either the photographic processing composition or in a layer of either of the elements.

A preferred embodiment of a diffusion transfer photographic film unit wherein the image-receiving element is designed to be retained with the photosensitive element after exposure and photographic processing generally includes: (1) a photosensitive element comprising a support carrying at least one silver halide emulsion layer, a polymeric acid reacting layer comprising inosine, and a timing layer; (2) an image-receiving element comprising a transparent support and carrying an image-receiving layer, and which is superposed or superposable on the photosensitive element; and (3) a rupturable container releasably holding an aqueous alkaline processing composition comprising hypoxanthine, and so positioned as to be adapted to distribute said processing composition between predetermined layers of the elements, all prepared as described herein.

In another preferred embodiment of a diffusion transfer photographic film unit wherein the image-receiving element is designed to be retained with the photosensitive element after exposure and photographic processing generally includes: (1) a photosensitive element comprising a support carrying at least one silver halide emulsion layer, a polymeric acid-reacting layer and a timing layer; (2) an image-receiving element comprising a transparent support and carrying an image-receiving layer, and which is superposed or superposable on the photosensitive element; and (3) a rupturable container releasably holding an aqueous alkaline processing composition comprising hypoxanthine and inosine, and so positioned as to be adapted to distribute the processing composition between predetermined layers of the elements, all prepared as described herein.

In another preferred embodiment of a diffusion transfer photographic film unit wherein the image-receiving element is designed to be retained with the photosensitive element after exposure and photographic processing generally includes: (1) a photosensitive element comprising a support carrying at least one silver halide emulsion layer, a polymeric acid-reacting layer and a timing layer; (2) an image-receiving element comprising a transparent support and carrying an image-receiving layer and a layer comprising nonylphenoxypolyoxyethylene, polyoxyethylene stearate and polyvinylpyrrolidone, as disclosed and claimed in U.S. patent application, Ser. No. 08/890,500 filed on even date herewith, and which is superposed or superposable on the photosensitive element; and (3) a rupturable container releasably holding an aqueous alkaline processing composition comprising hypoxanthine, inosine, a light-reflecting pigment and a light-absorbing optical filter agent, and so positioned as to be adapted to distribute the processing composition between predetermined layers of the elements, all prepared as described herein.

Further, the photosensitive element in any of the preferred embodiments mentioned above preferably includes an image dye-providing material in association with said silver halide emulsion layer(s). Moreover, the photosensitive element preferably includes a red-sensitive silver halide emulsion having a cyan image dye-providing material associated therewith, a green-sensitive silver halide emulsion layer having a magenta image dye-providing material associated therewith and a blue-sensitive silver halide emulsion layer having a yellow image dye-providing material associated therewith.

Each of the layers carried by the support(s) of the diffusion transfer photographic film units of the invention functions in a predetermined manner to provide desired diffusion transfer photographic processing as is well known in the art. It should also be understood that the image-receiving element may include additional layers such as a strip-coat layer, e.g., as disclosed and claimed in U.S. Pat. No. 5,346,800, and an overcoat layer, e.g., as disclosed and claimed in U.S. Pat. No. 5,415,969, and as is known in the art. In embodiments of the present invention wherein the diffusion transfer photographic film unit is of the peel-apart type, it is preferred to include a strip-coat layer.

Support material can comprise any of a variety of materials capable of carrying the other layers of image-receiving element. Paper, vinyl chloride polymers, polyamides such as nylon, polyesters such as polyethylene terephthalate, or cellulose derivatives such as cellulose acetate or cellulose acetate-butyrate, can be suitably employed. Depending upon the desired nature of the finished photograph, the nature of support material as a transparent, opaque or translucent material will be a matter of choice. Typically, an image-receiving element adapted to be used in peel-apart diffusion transfer film units and designed to be separated after processing will be based upon an opaque support material.

The support material of the image-receiving element shown in Example I herein is a transparent material for production of a photographic reflection print, and it will be appreciated that the support will be a transparent support material where the processing of a photographic transparency is desired. In one embodiment where the support material is a transparent sheet material, an opaque sheet (not shown), preferably pressure-sensitive, can be applied over the transparent support to permit in-light development. Upon photographic processing and subsequent removal of the opaque pressure-sensitive sheet, the photographic image diffused into image-bearing layer can be viewed as a transparency. As mentioned previously, since the support material of the image-receiving element is a transparent sheet, opacification materials such as carbon black and titanium dioxide can be incorporated in the processing composition to permit in-light development.

As mentioned above, the preferred diffusion transfer photographic film units of the invention include a pressure-rupturable container. Such pods and like structures are common in the art and generally define the means for providing the photographic processing composition to the, e.g., photosensitive element and image-receiving element. The processing composition typically comprises an aqueous alkaline composition which generally includes a silver halide developing agent and a silver halide solvent and may include other addenda as is known in the art. Examples of such aqueous alkaline processing compositions are found in U.S. Pat. Nos. 3,445,685; 3,597,197; 4,680,247; 4,756,996 and 5,422,233, as well as the patents cited therein.

In addition, the aqueous alkaline processing compositions utilized in the diffusion transfer photographic film units of the present invention may include one or more of the acylpyridine-N-oxide compounds disclosed and claimed in U.S. Pat. No. 5,604,079.

As mentioned earlier, the photosensitive system referred to above comprises a photosensitive silver halide emulsion. In a preferred color embodiment of the invention a corresponding image dye-providing material is provided in conjunction with the silver halide emulsion. The image dye-providing material is capable of providing, upon processing, a diffusible dye which is capable of diffusing to the image-receiving layer as a function of exposure. As described previously, preferred photographic diffusion transfer film units are intended to provide multicolor dye images and the photosensitive element is preferably one capable of providing such multicolor dye images. In a preferred black and white embodiment, the image-forming material utilized is complexed silver which diffuses from the photosensitive element to the image-receiving layer during processing. Moreover, the image-receiving layer utilized in such black and white embodiments typically includes silver nucleation materials. As stated earlier, both such photosensitive systems are well known in the art.

Briefly, however, in the black and white diffusion transfer film units of the present invention, a photosensitive element including a photosensitive silver halide emulsion is exposed to light and subjected to an aqueous alkaline solution comprising a silver halide developing agent and a silver halide solvent. The developing agent reduces exposed silver halide to an insoluble form and the unexposed silver halide, solubilized by the silver solvent, migrates to an image-receiving element. The image-receiving element of these film units typically comprises a support and an image-receiving layer including a silver precipitating material such as that referred to above wherein the soluble silver complex is precipitated or reduced to form a visible silver black and white image. The binder material for the overcoat layer in black and white embodiments should be permeable to the photographic alkaline processing fluid and to complexed silver salt which transfers to the image-receiving layer to provide an image. Examples of such black and white photographic film units are disclosed in U.S. Pat. Nos. 3,567,442; 3,390,991 and 3,607,269 and in E. H. Land, H. G. Rogers, and V. K. Walworth, in J. M. Sturge, ed., *Neblette's Handbook of Photography and Reprography*, 7th ed., Van Nostrand Reinhold, N.Y., 1977, pp. 258–330.

As mentioned previously, in a preferred embodiment, the photosensitive element of the diffusion transfer photographic film unit of the present invention includes a polymeric acid-reacting layer. The polymeric acid-reacting layer reduces the environmental pH of the film unit, subsequent to transfer image formation. As disclosed, for example, in U.S. Pat. No. 3,362,819, the polymeric acid-reacting layer may comprise a nondiffusible acid-reacting reagent adapted to lower the pH from the first (high) pH of the processing composition in which the image material (e.g. image dyes) is diffusible to a second (lower) pH at which they are not diffusible. The acid-reacting reagent is preferably a polymer which contains acid groups, e.g., carboxylic acid or sulfonic acid groups, which are capable of forming salts with alkaline metals or with organic bases, or potentially acid-yielding groups such as anhydrides or lactones. Thus, reduction in the environmental pH of the film unit is achieved by the conduct of a neutralization reaction between the alkali provided by the processing composition and a layer which comprises immobilized acid-reactive sites and which functions as a neutralization layer. Preferred polymers such a neutralization layer comprise such polymeric acids as cellulose acetate hydrogen phthalate; polyvinyl hydrogen phthalate; polyacrylic acid; polystyrene sulfonic acid; and maleic anhydride copolymers and half esters thereof.

Further, a polymeric acid-reacting layer can be applied, if desired, by coating the support layer with an organic solvent-based or water-based coating composition. A polymeric acid-reacting layer which is typically coated from an organic-based composition comprises a mixture of a half butyl ester of polyethylenelmaleic anhydride copolymer with polyvinyl butyral. A suitable water-based composition for the provision of a polymeric acid-reacting layer comprises a mixture of a water soluble polymeric acid and a water soluble matrix, or binder, material. Suitable water-soluble polymeric acids include ethylene/maleic anhydride copolymers and poly(methyl vinyl ether/maleic anhydride). Suitable water-soluble binders include polymeric materials such as polyvinyl alcohol, partially hydrolyzed polyvinyl acetate, carboxymethyl cellulose, hydroxyethyl cellulose, hydroxypropyl cellulose, polymethylvinylether or the like, as described in U.S. Pat. No. 3,756,815. As examples of useful polymeric acid-reacting layers, in addition to those disclosed in the U.S. Pat. Nos. 3,362,819 and 3,756,815, mention may be made of those disclosed in U.S. Pat. Nos. 3,415,644; 3,754,910; 3,765,885; 3,819,371 and 3,833,367.

Any suitable inert interlayer or spacer layer may be used in association with the polymeric acid layer to control or "time" the pH reduction so that it is not premature which would interfere with the development process. Suitable spacer or "timing" layers useful for this purpose are described with particularity in U.S. Pat. Nos. 3,362,819; 3,419,389; 3,421,893; 3,455,686; 3,575,701; 4,201,587; 4,288,523; 4,297,431; 4,391,895; 4,426,481; 4,458,001; 4,461,824; 4,457,451 and 5,593,810. It is preferred to include a timing layer in a diffusion transfer photographic film unit of the present invention which includes a polymeric acid-reacting layer.

As mentioned earlier, any suitable image-receiving layer which is designed for receiving an image-forming material which diffuses in an imagewise manner from the photosensitive element during processing may be used in the present invention. In color embodiments of the present invention, the image-receiving layer generally comprises a dyeable material which is permeable to the alkaline processing composition. The dyeable material may comprise polyvinyl alcohol together with a polyvinyl pyridine polymer such as poly(4-vinyl pyridine). Such image-receiving layers are further described in U.S. Pat. No. 3,148,061.

Another suitable image-receiving layer material comprises a graft copolymer of 4-vinyl pyridine and vinylbenzyltrimethylammonium chloride grafted onto hydroxyethyl cellulose. Such graft copolymers and their use as image-receiving layers are further described in U.S. Pat. Nos. 3,756,814 and 4,080,346. Other suitable materials can, however, be employed.

For example, suitable mordant materials of the vinylbenzyltrialkylammonium type are described, for example, in U.S. Pat. No. 3,770,439. Mordant polymers of the hydrazinium type (such as polymeric mordants prepared by quaternization of polyvinylbenzyl chloride with a disubstituted asymmetric hydrazine), e.g., those described in Great Britain Pat. No. 1,022,207, published Mar. 9, 1966, can also be employed. One such hydrazinium mordant is poly(1-vinylbenzyl 1,1-dimethylhydrazinium chloride) which, for example, can be admixed with polyvinyl alcohol for provision of a suitable image-receiving layer.

Yet another suitable mordant material for use in an image-receiving layer is a terpolymer comprising trimethyl-, triethyl- and tridodecyl-vinylbenzylammonium chloride, as described, for example, in U.S. Pat. Nos. 4,794,067; 5,591,560; and 5,593,809.

As stated earlier, the diffusion transfer photographic film units of the present invention may also include an overcoat layer, such as, for example, described in U.S. Pat. Nos. 5,415,969 and 5,633,114. Such an overcoat layer comprises a majority by dry weight of water-insoluble particles and a minority by dry weight of a binder material. The particles are substantially insoluble in water and non-swellable when wet. Furthermore, in order to minimize any light scatter by the overcoat layer, the particles typically have a small average particle size, for example, less than 300 mm and preferably less than 100 nm, and more preferably in the range of about 1 nm to 50 nm. The water-insoluble particles may comprise inorganic materials, e.g. colloidal silica, and/or organic materials, e.g. water-insoluble polymeric latex particles such as an acrylic emulsion resin. Colloidal silica is the preferred inorganic particle for use in such an overcoat layer, however, other inorganic particles may be used in combination or substituted therefor.

The binder material for the overcoat layer preferably comprises a water-insoluble latex material, however, the layer may comprise water soluble materials or combinations of water-insoluble and water soluble materials. Examples of applicable water soluble binder materials include ethylene acrylic acid, polyvinyl alcohol, gelatin, and the like.

One or more overcoat layers may be used in combination with other layers. Typically, each overcoat layer has a thickness of up to about 2 microns, and preferably between 1 and 1.5 microns. Such overcoat layers must allow sufficient image-providing material to be transferred to the image-receiving layer to provide a photograph of the desired quality. Furthermore, in the peel-apart type diffusion transfer photographic film units of the present invention since the overcoat layer(s) remains upon the image-receiving element after processing and separation from the photosensitive element, the overcoat layer(s) should not scatter visible light to any appreciable degree since the photograph will be viewed through such layer(s).

In a preferred embodiment of the present invention the image-receiving element includes a layer comprising a copolymer of Petrolite® D300, which is commercially available from Petrolite Corporation (Tulsa, Okla.), and Polyox N3K, which is commercially available from Union Carbide Corporation (Danbury, Conn.), at a ratio of about 3:1, respectively, and Aerosol-OS, which is commercially available from American Cyanamid Corporation (Stamford, Conn.).

The invention will now be described further in detail with respect to specific preferred embodiments by way of an example, it being understood that this example is intended to be illustrative only and the invention is not limited to the materials, conditions, process parameters, etc. recited therein. All parts and percentages recited are by weight unless otherwise stated.

EXAMPLE

Two (2) diffusion transfer photographic film units were prepared: one "test" film unit, i.e., a film unit prepared according to an embodiment of the present invention, and one "control" film unit, i.e., a film unit prepared in the same overall manner as the test film unit but without inosine.

More specifically, as will be described in detail below, the aqueous alkaline processing composition incorporated in the "test" diffusion transfer photographic film unit prepared according to embodiments of the present invention comprised hypoxanthine and inosine available from, e.g., Yick-Vic Chemicals and Pharmaceuticals (HK) LTD (Hong Kong) or Kyowa Hakko Kogyo Co., Ltd. (Tokyo, Japan).

The photosensitive elements used in the "control" and the "test" diffusion transfer photographic film units described above comprised an opaque subcoated polyethylene terephthalate photographic film base carrying in succession:

1. a polymeric acid-reacting layer coated at a coverage of about 24.212 mg/m$^2$ comprising a 1.2/1 ratio of AIR-FLEX® 465 (a vinyl acetate ethylene latex available from Air Products Co.) and GANTREZ® S-97 (a free acid of a copolymer of methyl vinyl ether and maleic anhydride available from GAF Corp.);
2. a timing layer coated at a coverage of about 4075.5 mg/m$^2$ comprising 4026.6 mg/m$^2$ of a copolymer of diacetone acrylamide and acrylamide grafted onto polyvinyl alcohol and 48.9 mg/m$^2$ of Aerosol-OS;
3. a cyan dye developer layer comprising about 500 mg/m$^2$ of the cyan dye developer represented by the formula

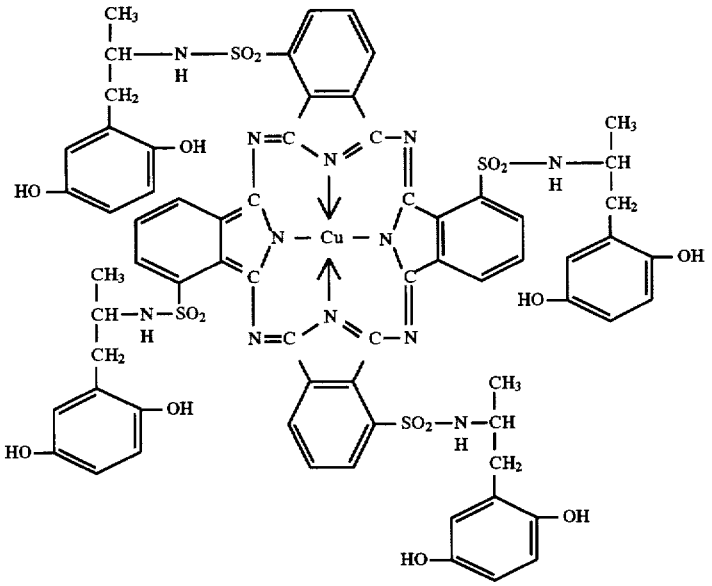

bout 274 mg/m$^2$ of gelatin, and about 184 mg/m$^2$ of methylphenylhydroquinone

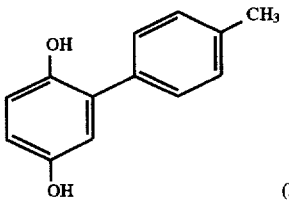

(MPHQ);

4. an interlayer comprising about 1000 mg/m$^2$ of titanium dioxide, about 374 mg/m$^2$ of a dispersion of polymethylmethacrylate beads (about 0.2 μm), about 124 mg/m$^2$ of gelatin, and about 374 mg/m$^2$ of a copolymer of butyl acrylate/diacetone acrylamide/methacrylic acid/styrene/acrylic acid;

5. a red-sensitive silver iodobromide layer comprising about 157 mg/m$^2$ of silver iodobromide (0.7 μm), about 525 mg/m$^2$ of silver iodobromide (1.5 μm), about 367 mg/m$^2$ of silver iodobromide (1.8 μm) and about 600 mg/m$^2$ of gelatin;

6. an interlayer comprising about 2976 mg/m$^2$ of a copolymer of butyl acrylate/diacetone acrylamide/methacrylic acid/styrene/acrylic acid and about 124 mg/m$^2$ of succindialdehyde;

7. a magenta dye developer layer comprising about 300 mg/m$^2$ of a magenta dye developer represented by the formula

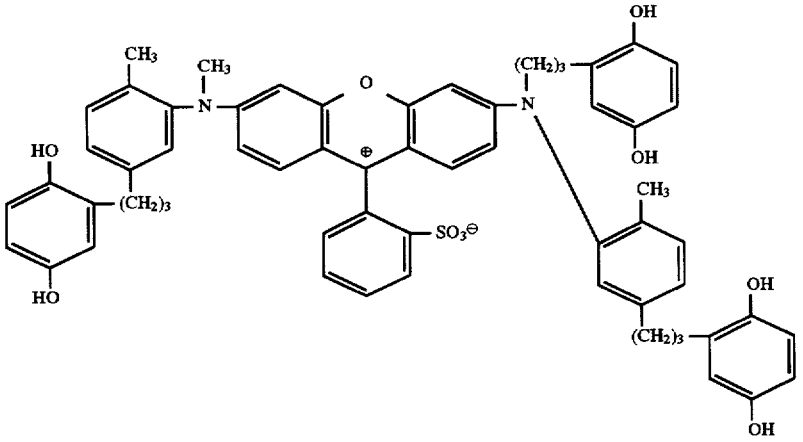

bout 30 mg/m$^2$ of benzylaminopurine, about 200 mg/m$^2$ of a releasable antifoggant

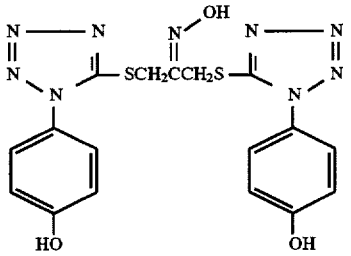

about 200 mg/m$^2$ of 2-phenyl benzimidazole and about 292 mg/m$^2$ of gelatin;

8. a layer comprising about 900 mg/m$^2$ of titanium dioxide, about 337 mg/m$^2$ of a dispersion of polymethylmethacrylate beads (about 0.2 μm), about 112 mg/m$^2$ of gelatin and about 337 mg/m$^2$ a copolymer of butyl acrylate/diacetone acrylamide/methacrylic acid/styrene/acrylic acid;

9. a green-sensitive silver iodobromide layer comprising about 220 mg/m$^2$ of silver iodobromide (1.1 μm), about 660 mg/m$^2$ of silver iodobromide (1.3 μm), about 220 mg/m$^2$ of silver iodobromide (1.5 μm) and about 484 mg/m$^2$ of gelatin;

10. a spacer layer comprising about 300 mg/m$^2$ tricrestylphosphate, about 136 mg/m$^2$ of MPHQ, about 136 mg/r$^2$ of a lactone developer represented by the formula

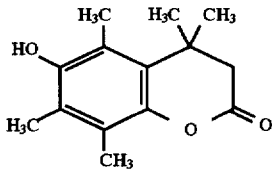

and about 249 mg/m$^2$ of gelatin;

11. an interlayer comprising about 1248 mg/m$^2$ of a copolymer of butyl acrylate/diacetone acrylamide/methacrylic acid/styrene/acrylic acid, and about 52 mg/m$^2$ of succindialdehyde;

12. a layer comprising about 1200 mg/m$^2$ of a scavenger (1-octadecyl-4,4-dimethyl-2-[2-hydroxy-5-(N-(7-caprolactamido)sulfonamido-phenyl]thiazolidine) and about 696 mg/m$^2$ of gelatin;

13. a yellow filter layer comprising about 400 mg/m$^2$ of a benzidine yellow dye, about 400 mg/m$^2$ of a polyvinylalcohol (Airvol® 325, available from Air Products Co.) and about 150 mg/m$^2$ of a hardener (available from R.H.Sands Corp. under the tradename OB 1

14.

14. a yellow image dye-providing layer comprising about 420 mg/m$^2$ of a yellow image dye-providing material represented by the formula

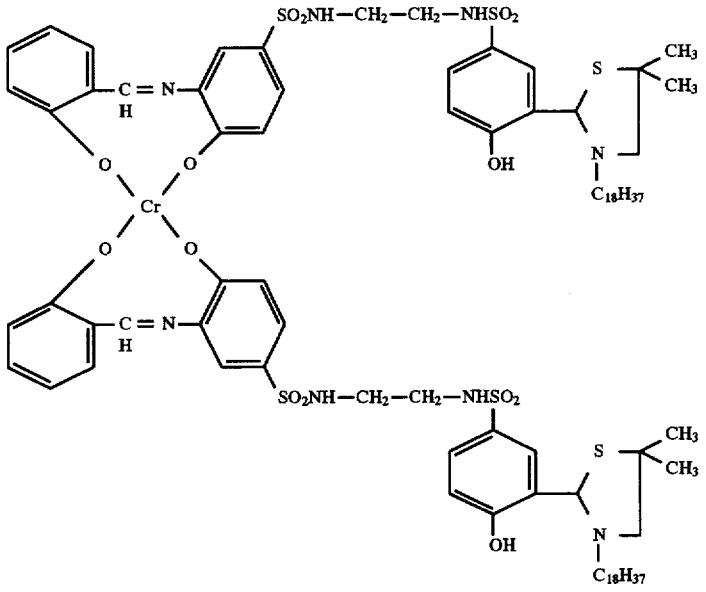

dispersed in Airvol, and about 280 mg/m$^2$ of gelatin;

15. a layer coated at a coverage of about 412 mg/m$^2$ of a tertoctylhydroquinone, about 206 mg/m$^2$ of dimethylterephalamide, about 45 mg/m$^2$ of an oxidative release restrainer compound (available from Fairmont Chemical, Inc.) and about 300 mg/m$^2$ of gelatin;

16. a blue-sensitive silver iodobromide layer comprising about 235 mg/m$^2$ of silver iodobromide (1.3 μm) and about 118 mg/m$^2$ of gelatin; and 17. a layer comprising about 450 mg/m$^2$ of a dispersion of polymethylmethacrylate beads (about 0.2 μm), and about 350 mg/m$^2$ of gelatin.

U.S. Pat. No. 5,571,656 discloses and claims the use of the lactone developer included in layer 10 above in diffusion transfer photographic film units.

The image-receiving elements used in the "control" and "test" diffusion transfer photographic film units comprised a transparent subcoated polyethylene terephthalate photographic film base carrying in succession:

1. an image-receiving layer coated at a coverage of about 2798 mg/m$^2$ comprising 2 parts of a terpolymer comprising vinylbenzyltrimethylammonium chloride, vinylbenzyltriethylammonium chloride and vinylbenzyldimethyldodecylammonium chloride (6.7/3.3/1 weight %, respectively) and 1 part of gelatin, about 12.5 mg/r$^2$ of dimethyl-2,4-imidazolinedione, about 53.8 mg/m$^2$ of ammonium nitrate and about 10.8 mg/m$^2$ of polymethylmethacrylate beads (available from Anitec Image, from about 4 μm to about 7 μm);

2. a layer coated at a coverage of about 810 mg/m$^2$ comprising about 540 mg/m$^2$ of Igepal® CO-997 and about 270 mg/m$^2$ of Type NP K-90; and 3. a layer coated at a coverage of about 430 mg/m$^2$ comprising about 323 mg/m$^2$ of Petrolite® (D300) and about 108 mg/m$^2$ of Polyox N3K, a ratio of about 3:1, respectively, and about 21.5 mg/m$^2$ of 0.1% of Aerosol-OS.

The example film units were prepared utilizing the image-receiving elements and photosensitive elements as described above. In each case, after photoexposure of the photosensitive element, the image-receiving element and the photosensitive element were arranged in face-to-face relationship, i.e. (with their respective supports outermost) and a rupturable container containing an aqueous alkaline processing composition was affixed between the image-receiving and photosensitive elements at the leading edge of each film unit such that the application of compressive pressure to the container would rupture the seal of the container along its marginal edge and distribute the contents uniformly between the respective elements. The chemical composition of the aqueous alkaline processing composition utilized for the processing of the "control" film unit is set forth in TABLE I.

TABLE I

| COMPONENT | PARTS BY WEIGHT |
|---|---|
| optical filter agent[1] | 1.10 |
| 4-methyl-benzenesulfinic acid | 1.00 |
| 6-methyluracil | 0.59 |
| hydrophobically modified polyacrylic acid | 1.20 |
| trans-4-(aminoethyl) cyclohexane carboxylic acid | 0.15 |
| 2-amino-1,7-dihydro-6H-purine-6-one | 0.25 |
| potassium hydroxide | 5.92 |
| silica, aqueous dispersion | 0.31 |
| 1-(4-hydroxyphenyl)-2-tetrazoline-5-thione | 0.02 |
| optical filter agent[2] | 0.13 |
| 1-(phenyl-N-propyl)-2-ethylpyridinium bromide, 50% aqueous solution | 0.07 |
| 1H-1,2,4-triazole | 0.18 |
| 2-ethyl-1-(2-dioxanylethyl)pyridinium bromide, 50% aqueous solution | 1.06 |
| titanium dioxide | 42.0 |
| hypoxanthine | 0.76 |
| 2-ethyl-1H-imidazole | 1.68 |
| optical filter agent[3] | 0.11 |
| water | balance to 100 |

TABLE I-continued

| COMPONENT | PARTS BY WEIGHT |
|---|---|
| 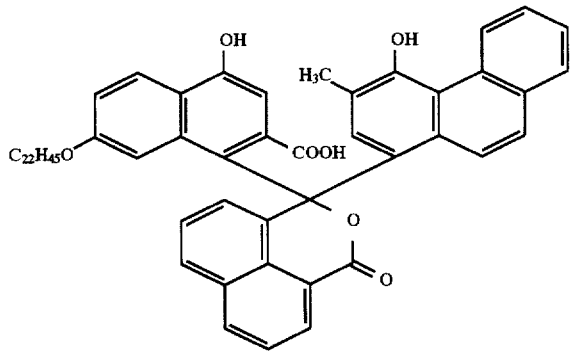 | |
| 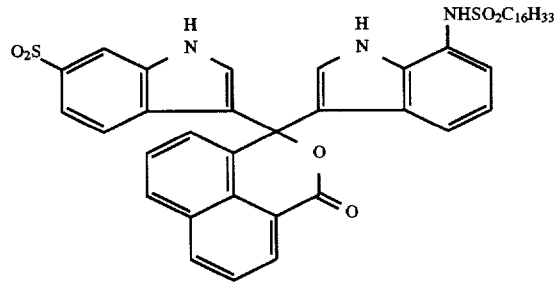 | |
| 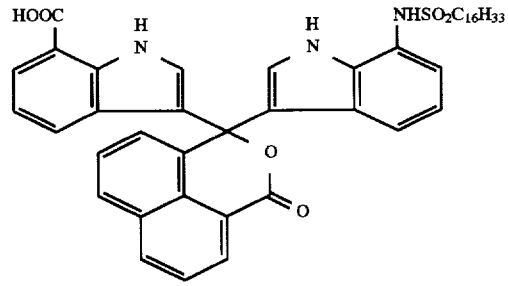 | |

The aqueous alkaline processing composition incorporated in the "test" diffusion transfer photographic film unit further included about 0.30 parts by weight of inosine.

Each film unit, after exposure to a sensitometric target, was passed through a pair of rollers set at a gap spacing of about 0.007 mm at room temperature, and the final image was viewed through the transparent support.

The red, blue and green maximum ($D_{max}$) and minimum ($D_{min}$) reflection densities which were read on a MacBeth Densitometer are shown in TABLE II below.

TABLE II

| | RED | | GREEN | | BLUE | |
|---|---|---|---|---|---|---|
| FILM UNIT | $D_{max}$ | $D_{min}$ | $D_{max}$ | $D_{min}$ | $D_{max}$ | $D_{min}$ |
| Control | 172.8 | 0.16 | 193.8 | 0.18 | 171.6 | 0.14 |
| Test | 175.3 | 0.16 | 195.9 | 0.18 | 172.1 | 0.14 |

It will be understood from the $D_{max}$ data reported in TABLE II that both the "control" and the "test" diffusion transfer photographic film units allow sufficient image dye-providing materials to diffuse to the image-receiving layer. Also, it will be appreciated from the $D_{min}$ data of TABLE II that both the "control" and the "test" diffusion transfer photographic film units provide photographs with acceptable backgrounds.

In addition to the beneficial effects described above, and as determined upon visual examination and handling of the finished photographs generated from the diffusion transfer photographic film units of this Example, the use of an aqueous alkaline processing composition which includes inosine, in addition to hypoxanthine, according to the present invention, i.e., in the "test" photographic film unit, substantially eliminates crystal formation in the final image of the finished photograph over time. Mass spectroscopic analysis of the raised areas, or crystals, visible on the final image of the "control" finished photograph within about one month of the photographic processing described above, and excised therefrom, indicates that the crystals contain predominantly hypoxanthine.

Although the invention has been described in detail with respect to various preferred embodiments thereof, those skilled in the art will recognize that the invention is not limited thereto but rather that variations and modifications can be made which are within the spirit of the invention and the scope of the appended claims.

What is claimed is:

1. A method for forming a diffusion transfer image comprising the steps of:

exposing a photosensitive element comprising a support carrying at least one silver halide emulsion layer to an imagewise pattern of radiation;

developing said exposed photosensitive element with an aqueous alkaline processing composition in the presence of inosine, wherein said processing composition includes hypoxanthine; and forming an image on an image-receiving layer.

2. A method as defined in claim 1 wherein said inosine is included in said processing composition.

3. A method as defined in claim 1 wherein said support of said photosensitive element carries a polymeric acid reacting layer.

4. A method as defined in claim 3 wherein said inosine is included in said polymeric acid reacting layer.

5. A method as defined in claim 2 wherein said processing composition comprises from about 0.05% to about 0.5%, by weight, of said inosine.

6. A method as defined in claim 5 wherein said processing composition comprises from about 0.10% by weight to about 0.30% by weight of said inosine.

7. A method as defined in claim 6 wherein said processing composition comprises from about 0.50% by weight to about 1.5% by weight of said hypoxanthine.

8. A diffusion transfer photographic film unit which comprises: a support; at least one silver halide emulsion layer; an image-receiving layer; an aqueous alkaline processing composition which includes hypoxanthine; and inosine.

9. A diffusion transfer photographic film unit as defined in claim 8 wherein said inosine is included in said processing composition.

10. A diffusion transfer photographic film unit as defined in claim 8 wherein said support carries a polymeric acid reacting layer.

11. A diffusion transfer photographic film unit as defined in claim 10 wherein said inosine is included in said polymeric acid reacting layer.

12. A diffusion transfer photographic film unit as defined in claim 9 wherein said processing composition comprises from about 0.05% by weight to about 0.5% by weight of said inosine.

13. A diffusion transfer photographic film unit as defined in claim 12 wherein said processing composition comprises from about 0.10% by weight to about 0.30% by weight of said inosine.

14. A diffusion transfer photographic film unit as defined in claim 13 wherein said processing composition comprises from about 0.50% by weight to about 1.5% by weight of said hypoxanthine.

15. A diffusion transfer photographic film unit as defined in claim 8 wherein said support carries a red-sensitive silver halide emulsion layer having a cyan image dye-providing material associated therewith, a green-sensitive silver halide emulsion layer having a magenta image dye-providing material associated therewith and a blue-sensitive silver halide emulsion layer having a yellow image dye-providing material associated therewith.

16. An aqueous alkaline processing composition for use with a diffusion transfer photographic film unit which comprises: a silver halide developing agent, a silver halide solvent, hypoxanthine and inosine.

17. A processing composition as defined in claim 16 which comprises from about 0.05% by weight to about 0.50% by weight of said inosine.

18. A processing composition as defined in claim 17 which comprises from about 0.50% by weight to about 1.5% by weight of said hypoxanthine.

19. A processing composition as defined in claim 16 which comprises from about 0.10% by weight to about 0.30% by weight of said inosine.

20. A processing composition as defined in claim 19 which comprises from about 0.50% by weight to about 1.5% by weight of said hypoxanthine.

* * * * *